US007641356B2

(12) United States Patent
Pieroth

(10) Patent No.: US 7,641,356 B2
(45) Date of Patent: Jan. 5, 2010

(54) BEDSIDE FLASHLIGHT CRADLE

(76) Inventor: Robert F. Pieroth, 200 N. Glendora Ave., Suite H, Glendora, CA (US) 91741

( * ) Notice: Subject to any disclaimer, the term of this patent is extended or adjusted under 35 U.S.C. 154(b) by 0 days.

(21) Appl. No.: 11/633,825

(22) Filed: Dec. 5, 2006

(65) Prior Publication Data

US 2007/0211455 A1 Sep. 13, 2007

Related U.S. Application Data

(60) Provisional application No. 60/742,227, filed on Dec. 5, 2005.

(51) Int. Cl.
*A47B 23/06* (2006.01)
*F21L 4/00* (2006.01)
*A47G 29/00* (2006.01)

(52) U.S. Cl. ..... 362/130; 362/190; 362/191; 362/157; 248/214; 248/215; 248/230.1; 248/230.7; 248/316.7; 248/339; 248/340

(58) Field of Classification Search ..... 362/130, 362/157, 190–191; 248/214–215, 230.1, 248/230.7, 316.7, 339–340
See application file for complete search history.

(56) References Cited

U.S. PATENT DOCUMENTS

| | | | | |
|---|---|---|---|---|
| 5,848,834 | A * | 12/1998 | Kerr | 362/190 |
| 6,206,543 | B1 * | 3/2001 | Henry | 362/191 |
| D455,065 | S * | 4/2002 | Berg | D8/371 |
| 6,409,131 | B1 * | 6/2002 | Bentley et al. | 248/219.4 |
| 6,854,139 | B2 * | 2/2005 | Lamy | 5/485 |

* cited by examiner

*Primary Examiner*—Sharon E Payne
*Assistant Examiner*—Sean P Gramling
(74) *Attorney, Agent, or Firm*—Myers Andras Sherman LLP; Joseph C. Andras

(57) ABSTRACT

A bedside flashlight cradle for supporting a flashlight from the side of a bed frame for ready access. The cradle includes a grasper end for connection to the bed frame, a middle section, and a cradle. The grasper end may attach to the bed frame without fastener, for example, by sliding over the vertical side wall of the bed frame. The middle section may cant backward in order to support the flashlight flush with the edge of the bed frame. The cradle may be provided in spaced apart pairs to support the flash light or in other configurations such as an integral unit that has sufficient width to support a flashlight or an integral unit that has a single grasper end of sufficient width with a pair of spaced-apart cradles.

2 Claims, 12 Drawing Sheets isometric side view top view front view

BEDSIDE FLASHLIGHT CRADLE

This applications claims the benefit of U.S. provisional patent application No. 60/742,227 filed on Dec. 5, 2005.

FIELD OF THE INVENTION

The present invention relates generally to flashlights and, more particularly, to a bedside flashlight cradle.

BACKGROUND OF THE RELATED ART

Many flashlight owners choose to keep their flashlight in their bedroom so that it is accessible in the event of a power failure or other emergency. However, a 3 or 4 D battery flashlight is hard to find a safe place for, because of its weight and length. In the bedroom, because one will be looking for the flashlight in the dark when needed, it is important that the flashlight be easily accessible when needed, i.e. that it be located within arms length.

Flashlight owners often have a nightstand near their bed. However, it is undesirable to simply lay the flashlight on the nightstand because it may roll off, or may be covered with other items. It is also impractical to stand the flashlight on end, on the nightstand, because it is easily knocked over. Of course, when a drawer is available, it may be possible to store the flashlight in the drawer. However, the owner may forget where it is, or even if the owner remembers, she may have difficultly finding it amongst the other items in the drawer when needed.

Some flashlight brackets are commercially available, but the ones known to the present inventor are generally designed for screw mounting to the wall of a garage or utility room, and are not well suited for use in the bedroom. For bedroom purposes, such a bracket could be screwed to the bedroom wall near the bed, or perhaps, to the side of the nightstand, but neither option is very desirable from an aesthetic point of view.

There remains a need, therefore, for a bedside flashlight cradle.

BRIEF DESCRIPTION OF THE DRAWINGS

The invention can be best understood with reference to the following description taken in view of the drawings of the preferred and various alternative embodiments of which.

DETAILED DESCRIPTION OF THE PREFERRED EMBODIMENT

Figure 1:
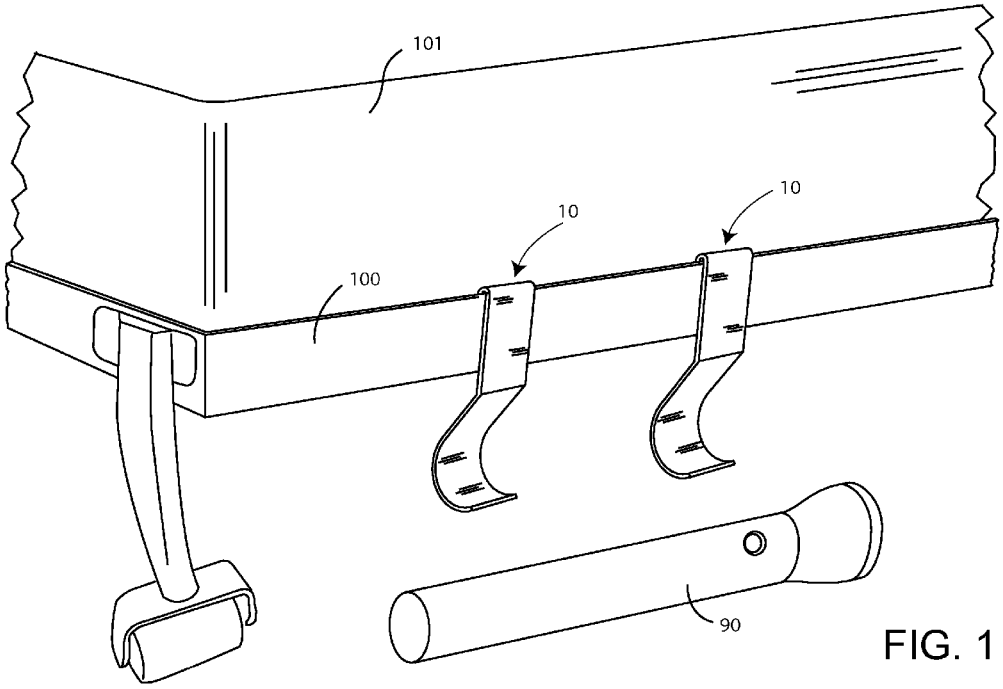
FIG. 1 is a perspective view of a bedside flashlight cradle 10 that is capable of supporting a flashlight 90 (shown adjacent) from a bed frame 100 according to a first preferred embodiment of the invention.
Figure 2:
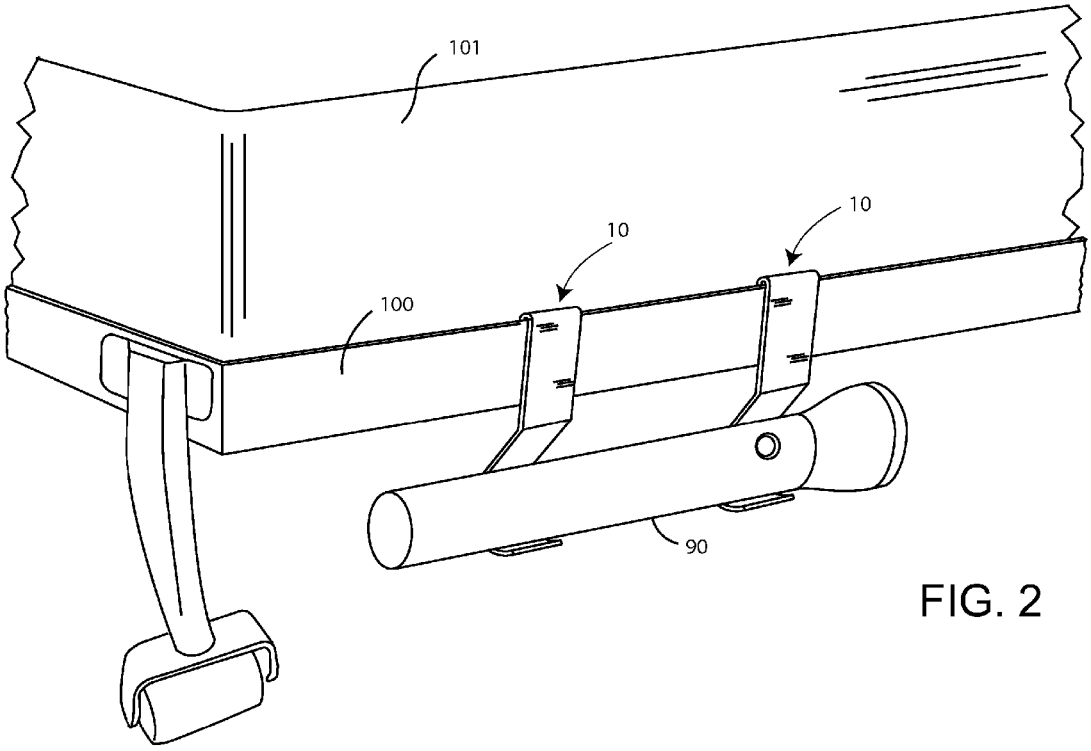
FIG. 2 is a perspective view of the flashlight cradle 10 of FIG. 1 with the flashlight 90 in the cradle 10.
Figure 3:
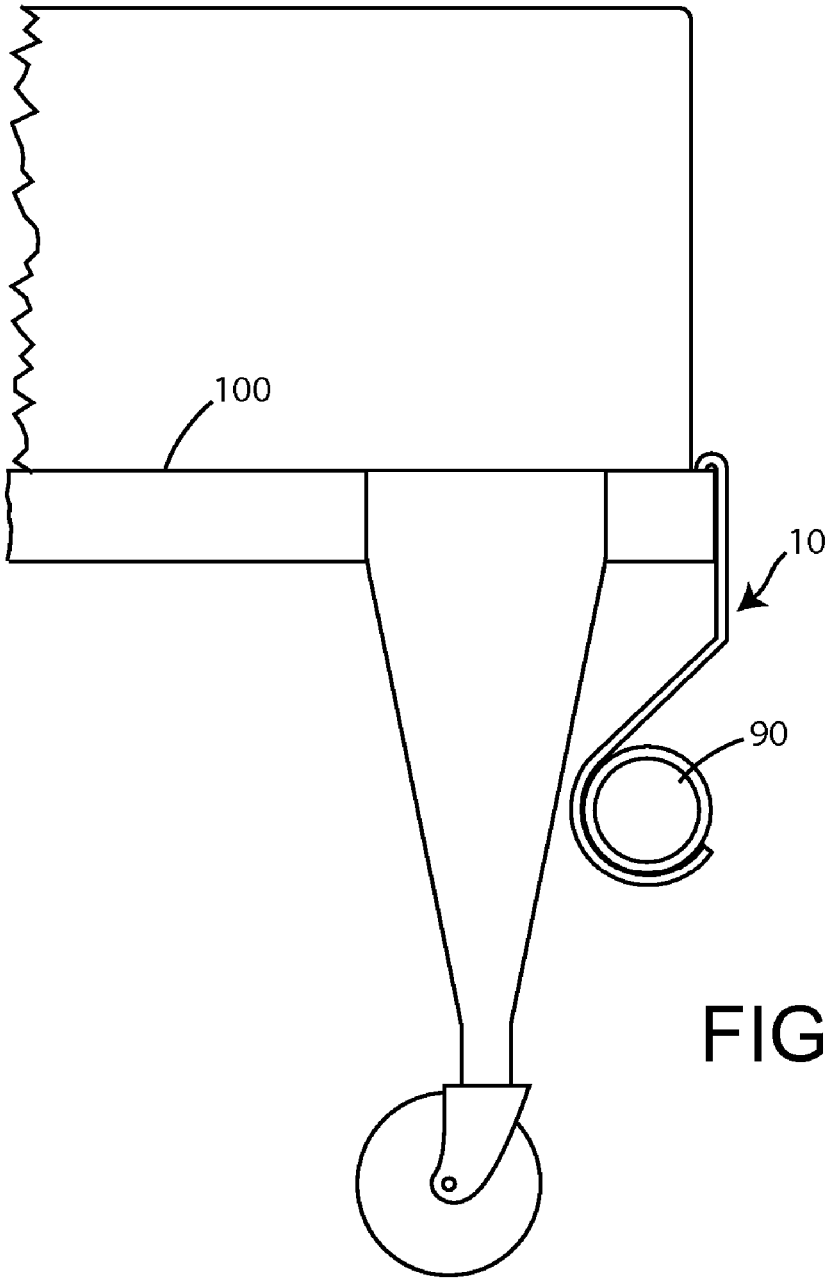
FIG. 3 an end view of the flashlight cradle 10 of FIG. 1 with the flashlight 90 in the cradle 10.
Figure 4A:
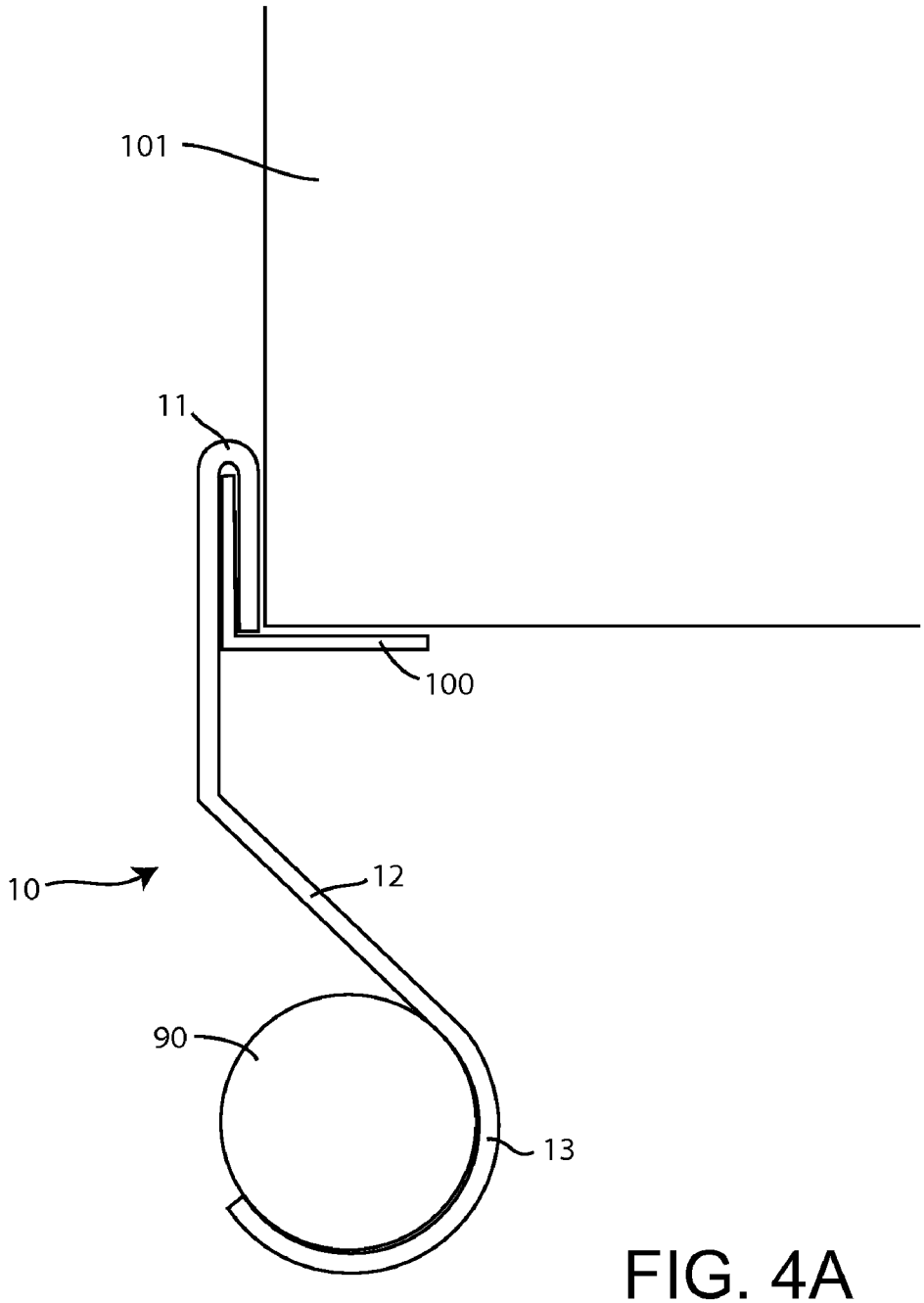
FIG. 4A is an end view of the bedside flashlight cradle 10 of FIG. 1, with the flashlight 90 held therein.
Figure 4B:
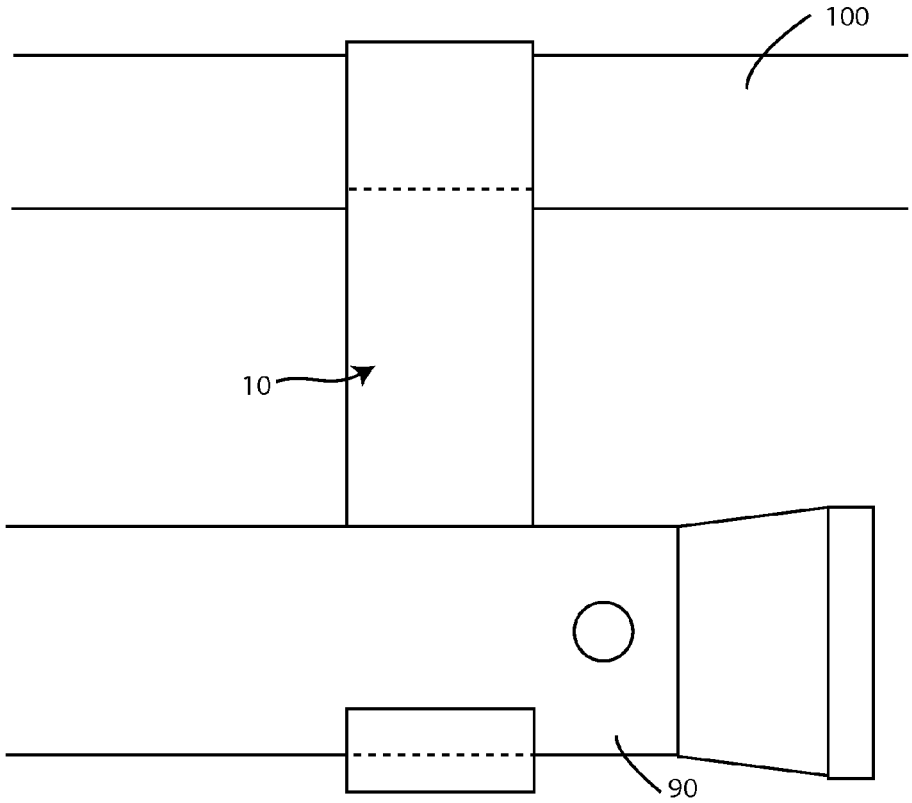
FIG. 4B is a side view of the bedside flashlight cradle 10 of FIG. 1, with the flashlight 90 held therein.
Figure 6:
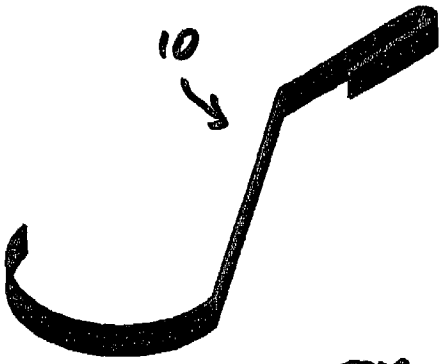
FIGS. 5-8 are top, isometric, front and end views of the bedside flashlight cradle 10 of FIG. 1.
Figure 8:
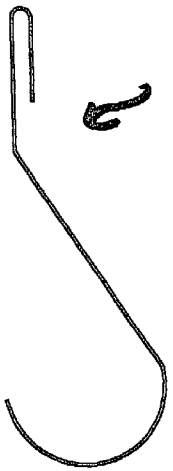
Figure 5:
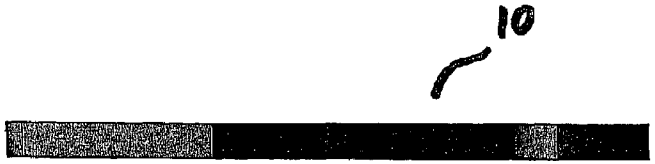
Figure 7:
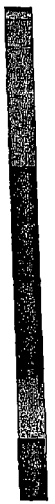

As shown in FIGS. 1-8, the first preferred flashlight cradle 10 is formed from two separate cradle members that clip onto the bed frame 100 that ordinarily supports the box spring 101. As a beneficial result, the flashlight is stored just under the rails of the bed frame 100. This location is particularly convenient because it is immediately adjacent to where the owner sleeps, and the owner can reach it without even having to sit up.

As shown in FIGS. 1-9, the first preferred flashlight cradle 10 is mounted to the bed frame rail 100 without tools or sheet metal screws. In particular, a top portion of the first preferred flashlight cradle 10 includes a fastener-free means 11 for grasping the bed frame 100. Here, as best shown in FIG. 4A, the grasping means 11 includes an inverted U-shaped bend that slips over the vertical wall of the L-shaped rail of the bed frame 100.

As further shown in FIGS. 1-8, the first preferred flashlight cradle 10 includes a middle section 12 that is canted backward, away from the grasping means 11, so that the flashlight 90 is supported substantially flush with the side of the bed frame 100 and box spring 101. Through this canted arrangement, the flashlight is completely under the bed so that the bed skirt typically present will hide it from view As further shown in FIGS. 1-8, the first preferred flashlight cradle 10 supports the flashlight 90 in a lower C-shaped cradle 13. The preferred cradle 13 has a diameter that is slightly less than the diameter of the flashlight 90, and some spring and flexibility that permits the C-shaped cradle 13 to firmly grasp the flashlight. The cradle 13 can be sized to accommodate both C & D size battery flashlights.

As shown, the flashlight cradle 10 according to the first preferred embodiment comprises two 1" wide, ⅛" thick brackets 10, 10 that conveniently cradle a flashlight 90 under the bed. The first preferred flashlight cradle 10 may be formed from any suitable material, including, but not limited to, metal (e.g. steel or aluminum), or a polymer (e.g. injection molded plastic). The first preferred bedside flashlight cradle 10 is formed from two separate cradle members 10, 10 that may be positioned to any desired position along the bed frame 100, i.e. to the best location for easy access. Moreover, because the preferred cradle 10 uses two separate brackets 10, 10, the two brackets may be variably spaced from one another to flashlights of different length (2D-3D-4D etc.). The cradle brackets 10 may, of course, be used on either or on both sides of the bed.

While FIGS. 1-8 illustrate the presently preferred embodiment, numerous other embodiments are possible.

Figure 9:
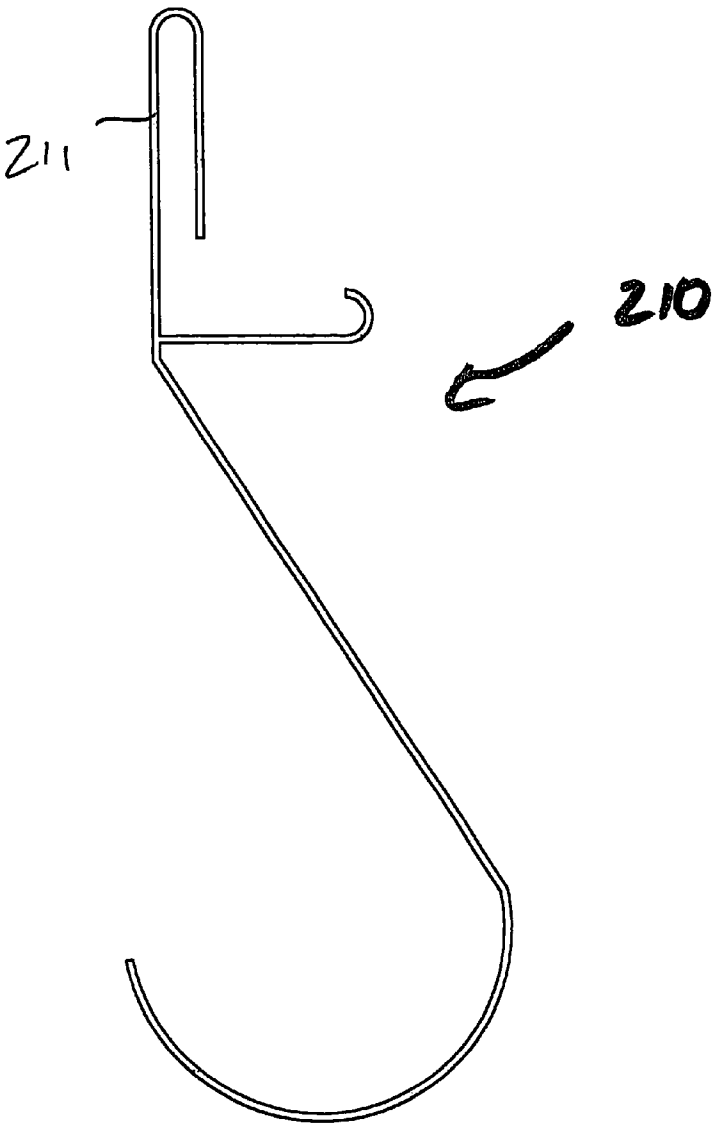
FIG. 9 an end view of a bedside flashlight cradle 210 according to a second embodiment of the invention.

In FIG. 9, for example, a flashlight cradle 210 according to a second embodiment has an upper grasping means 211 that grips the vertical side wall of the L-shaped rails of the bed frame 100 and the horizontal bottom wall of the L-shaped rail of the bed frame 100.

Figure 10:
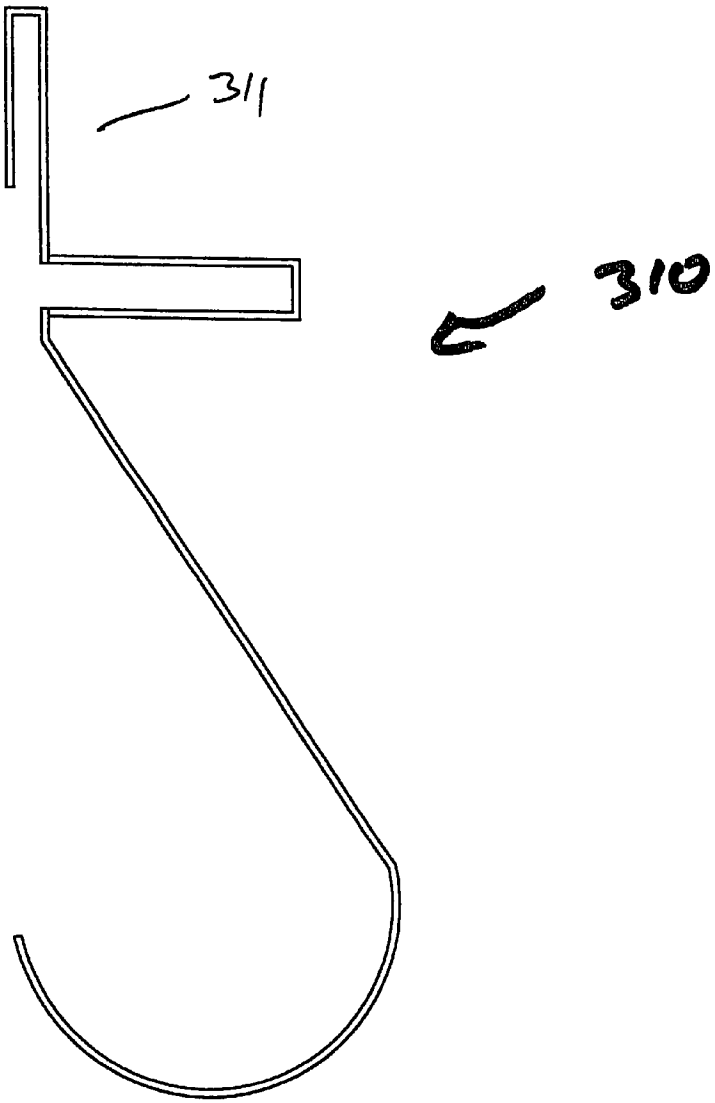
FIG. 10 an end view of a bedside flashlight cradle 310 according to a third embodiment of the invention.

FIG. 10 shows a flashlight cradle 310 according to a third embodiment that includes a slightly different grasping means 311 that grips the both walls of the L-shaped rail, but from the back side, rather than from the front side.

Figure 11:
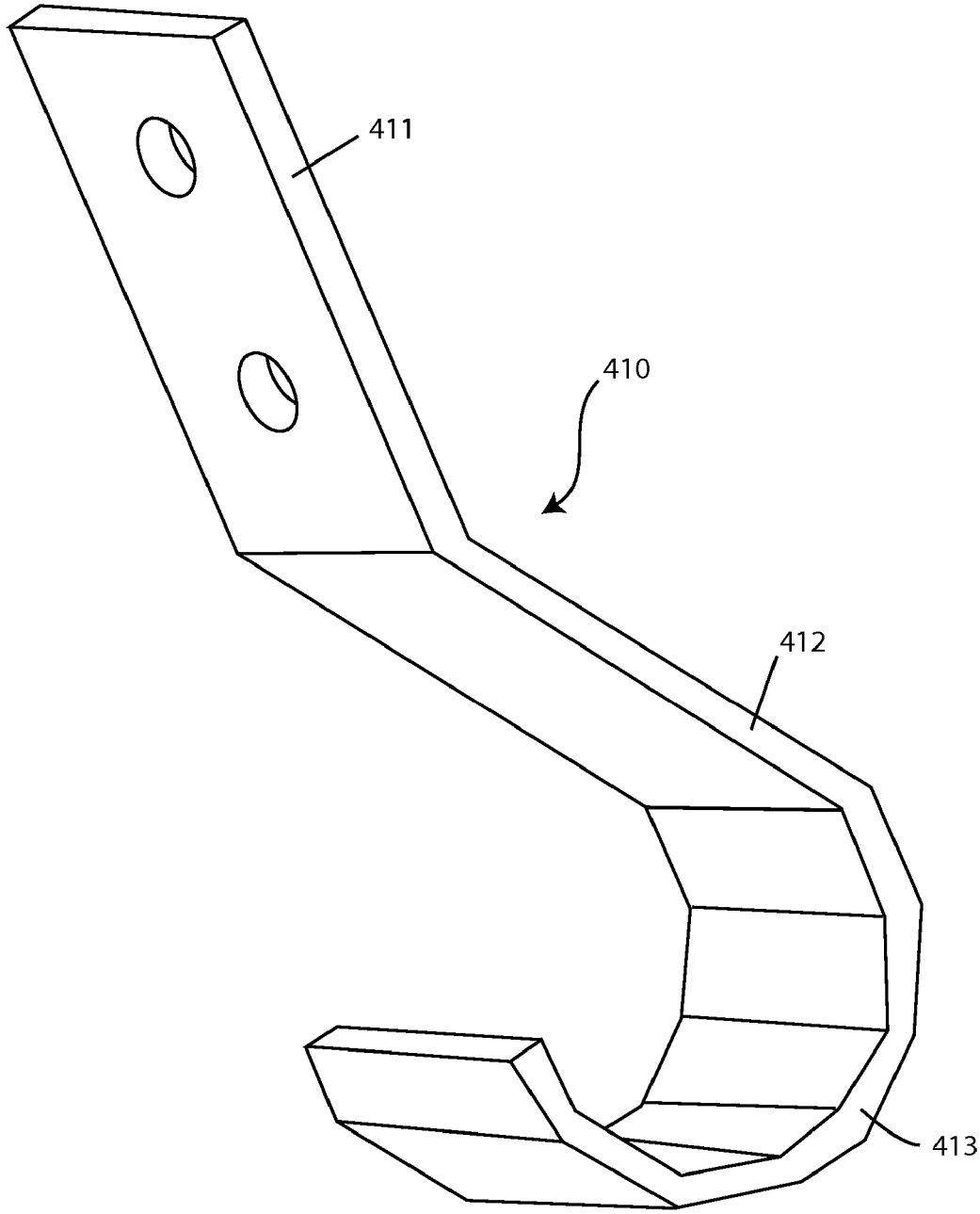
FIG. 11 an end view of a bedside flashlight cradle 410 according to a fourth embodiment of the invention.

FIG. 11 shows a flashlight cradle 410 according to a fourth embodiment of the invention. Here, the flashlight cradle 410 includes a C-shaped cradle 413 and a middle section 412 that is canted backward to support the flashlight (not shown) substantially flush with the bed. At the top, however, the flashlight cradle 410 has a mounting portion with two or more apertures for mounting the cradle 410 to the bed frame (not shown). This embodiment would be useful with wood screws where the bed frame is made of wood, but it could be employed with other bed frames using suitable fasteners (e.g. nuts and bolts, metal screws, rivets, etc. . . . )

Figure 12:
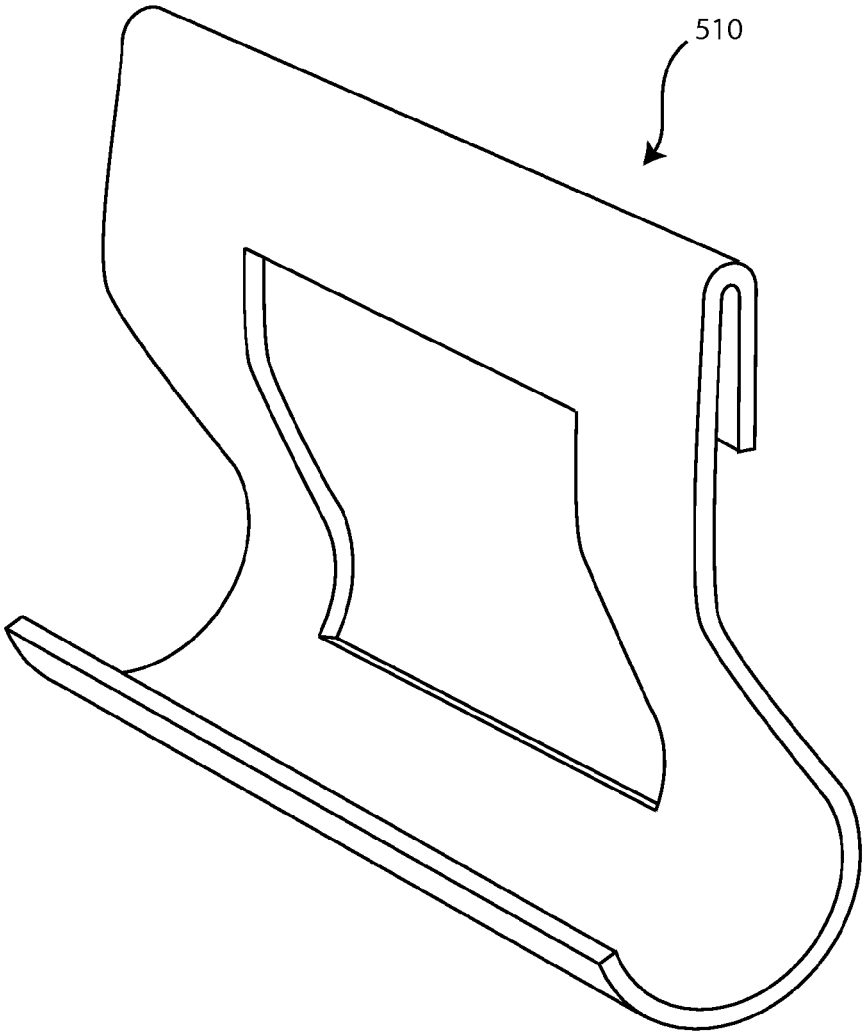
FIG. 12 an end view of a bedside flashlight cradle 510 according to a fifth embodiment of the invention.
Figure 13:
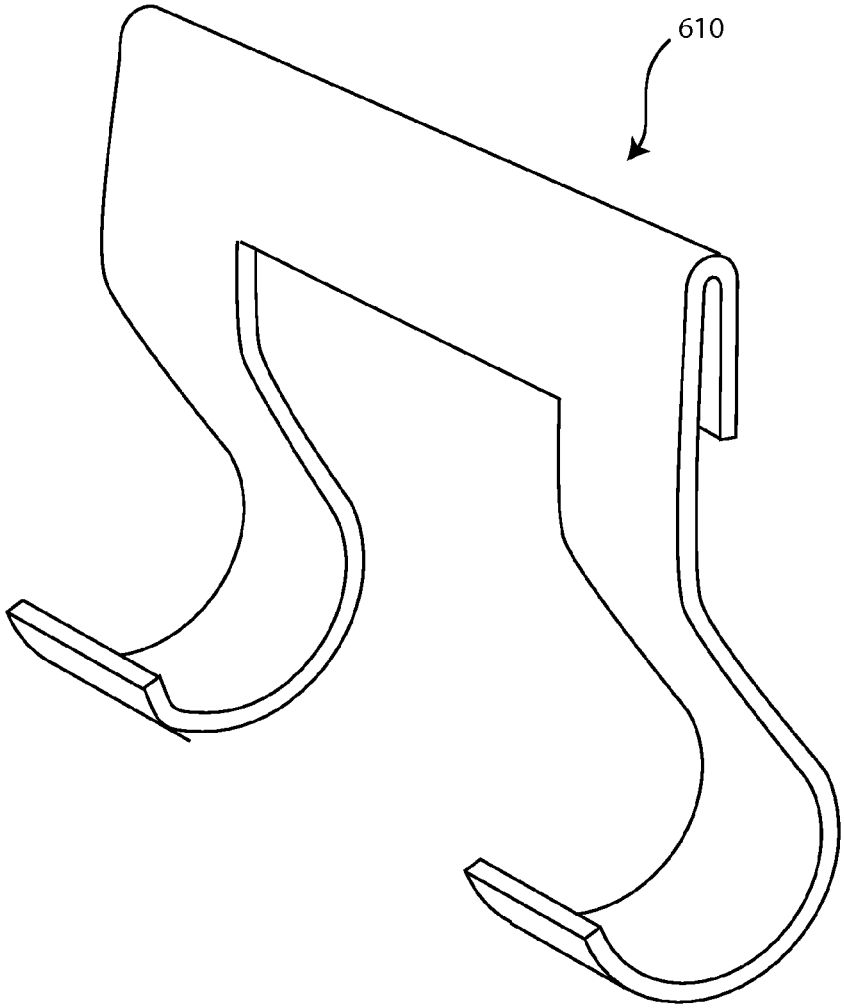
FIG. 13 an end view of a bedside flashlight cradle 610 according to a sixth embodiment of the invention.

FIGS. 12 and 13 illustrate fifth and sixth embodiments 510, 610 where the cradles 510, 610 are formed from a single integral member, rather than from two separate members. In such case, a central portion of the cradle 510, 610 may beneficially be provided as a void to reduce material cost and weight, particularly when the cradle is formed from injection molded plastic.

Figure 14:
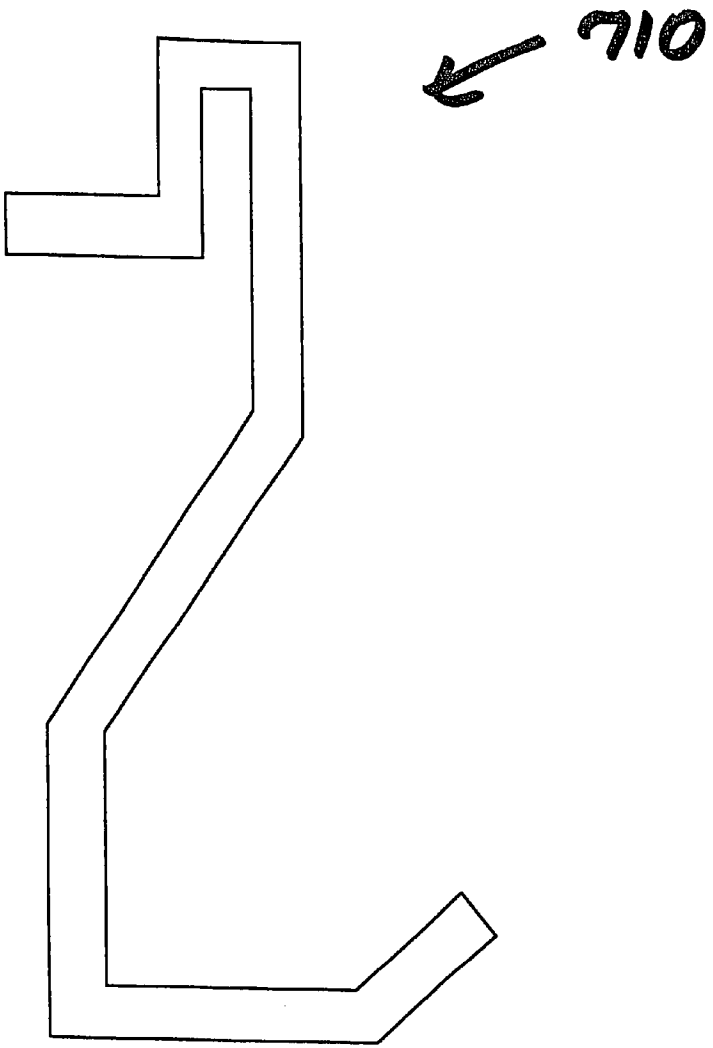
FIG. 14 an end view of a bedside flashlight cradle 710 according to a seventh embodiment of the invention.

FIG. 14, lastly, shows a cradle 710 according to a seventh embodiment where the smoothly curved walls of the prior embodiments have been replaced with angular walls. Nonetheless, the grasping means, canted middle section, and substantially C-shaped cradle still remain in this embodiment.

I claim:

1. A method of securing a flashlight beneath a bed frame with a hook member that has a top retention portion and a lower C-shaped portion, the bed frame formed from an L-shaped rail with a vertical wall and a horizontal wall, the method comprising the steps of:

providing an inverted U-shaped bend in the top retention portion of the hook member;

attaching the inverted U-shaped bend in the top retention portion of the hook member to the vertical wall of the L-shaped rail of the bed frame;

providing a middle portion extending below and canted backward away from the top portion to beneath the bed frame; and securing a flashlight in the lower C-shaped portion of the hook member whereby the C-shaped portion supports the flashlight below the bed frame and substantially flush with a side of the bed frame.

2. A method of securing a flashlight beneath a bed frame with a hook member that has a top retention portion and a lower C-shaped portion, the bed frame formed from an L-shaped horizontally-extending rail with a vertical wall and a horizontal wall, the method comprising the steps of:

providing an inverted U-shaped bend in the top retention portion of the hook member, the inverted U-shaped bend having a gap that is sized to slip downwardly over the vertical wall of the L-shaped horizontally-extending rail;

attaching the inverted U-shaped bend in the top retention portion of the hook member to the vertical wall of the L-shaped horizontally-extending rail of the bed frame by slipping the U-shaped bend over the vertical wall of the L-shaped horizontally-extending rail;

providing an angled middle portion that connects the U-shaped bend of the top retention portion to the C-shaped portion, the angled middle portion extending below and canted backward away from the top portion to position the C-shaped portion beneath the L-shaped horizontally-extending rail of the bed frame; and horizontally securing a flashlight beneath the bed frame within the lower C-shaped portion of the hook member, the C-shaped portion supporting the flashlight below the L-shaped horizontally-extending rail of the bed frame and substantially flush with an external side of the vertical wall of the L-shaped horizontally-extending rail of the bed frame, the flashlight being transversely removable from the C-shaped portion of the hook member for use.

* * * * *